US011274373B2

(12) United States Patent
Marmann et al.

(10) Patent No.: US 11,274,373 B2
(45) **Date of Patent: *Mar. 15, 2022**

(54) METHOD FOR THE PRODUCTION OF A METAL STRIP COATED WITH A COATING OF CHROMIUM AND CHROMIUM OXIDE USING AN ELECTROLYTE SOLUTION WITH A TRIVALENT CHROMIUM COMPOUND

(71) Applicants: thyssenkrupp Rasselstein GmbH, Andernach (DE); thyssenkrupp AG, Essen (DE)

(72) Inventors: Andrea Marmann, Piesport (DE); Christoph Molls, Bonn (DE); Rainer Görtz, Bad Breising (DE); Thomas Lenz, Sinzig (DE)

(73) Assignees: THYSSENKRUPP RASSELSTEIN GMBH, Andernach (DE); THYSSENKRUPP AG, Essen (DE)

( * ) Notice: Subject to any disclaimer, the term of this patent is extended or adjusted under 35 U.S.C. 154(b) by 33 days.

This patent is subject to a terminal disclaimer.

(21) Appl. No.: 16/711,859

(22) Filed: Dec. 12, 2019

(65) Prior Publication Data

US 2020/0190679 A1 Jun. 18, 2020

(30) Foreign Application Priority Data

Dec. 13, 2018 (DE) ..... 10 2018 132 075.2

(51) Int. Cl.
*C25D 3/06* (2006.01)
*C25D 17/28* (2006.01)
*C25D 7/06* (2006.01)

(52) U.S. Cl.
CPC ..... *C25D 3/06* (2013.01); *C25D 7/0614* (2013.01); *C25D 17/28* (2013.01)

(58) Field of Classification Search
None
See application file for complete search history.

(56) References Cited

U.S. PATENT DOCUMENTS 3,316,160 A 4/1967 Uchida et al.
10,422,049 B2 9/2019 Wijenberg
(Continued)

FOREIGN PATENT DOCUMENTS

EP 3112502 A1 1/2017
EP 3378973 A1 9/2018
(Continued)

OTHER PUBLICATIONS

European Search Reports for European Application Nos. 19206950 and 19206952 dated Mar. 23, 2020.
(Continued)

*Primary Examiner* — Wojciech Haske
(74) *Attorney, Agent, or Firm* — Paul D. Bianco; Katharine Davis; Fleit Intellectual Property Law

(57) ABSTRACT

A method for producing a metal strip coated with a coating that contains chromium metal and chromium oxide and is electrolytically deposited from an electrolyte solution that contains a trivalent chromium compound onto the metal strip by bringing the metal strip, which is connected as the cathode, into contact with the electrolyte solution. An efficient deposition of coating with a high proportion of chromium oxide is obtained by successively passing the metal strip through a plurality of electrolysis tanks. The electrolyte solution in at least the last electrolysis tank, as viewed in the strip travel direction, or in a rear group of electrolysis tanks has an average temperature of at most 40° C., and the electrolysis time, during which the metal strip is in electro-
(Continued)

lytically effective contact with the electrolyte solution in the last electrolysis tank or in the rear group of electrolysis tanks is less than 2.0 seconds.

22 Claims, 5 Drawing Sheets

(56) References Cited

U.S. PATENT DOCUMENTS

| | | | | |
|---|---|---|---|---|
| 2015/0064494 | A1* | 3/2015 | Wijenberg | C25D 5/36 428/623 |
| 2016/0064494 | A1 | 3/2016 | Chan et al. | |
| 2016/0138178 | A1 | 5/2016 | Wijenberg | |
| 2017/0081773 | A1 | 3/2017 | Wijenberg et al. | |
| 2018/0320281 | A1* | 11/2018 | Mull | C25D 5/36 |
| 2020/0190684 | A1 | 6/2020 | Marmann | |

FOREIGN PATENT DOCUMENTS

| | | | |
|---|---|---|---|
| JP | 2016-528378 | A | 9/2016 |
| JP | 2017-519103 | | 7/2017 |
| WO | 2014/079909 | A1 | 5/2014 |
| WO | 2014079909 | A1 | 5/2014 |
| WO | 2015/177314 | A1 | 11/2015 |
| WO | 2015177314 | A1 | 11/2015 |
| WO | 2015177315 | A1 | 11/2015 |
| WO | 2018087135 | A1 | 5/2018 |

OTHER PUBLICATIONS

Office Action dated May 7, 2021 for U.S. Appl. No. 16/711,703.

Office Action dated Mar. 2021 for Korean Patent Application No. 10-2019-0165574 (English translation) (8 pages).

Office Action dated Jan. 26, 2021, for Japanese Patent Application No. 2019-221836 (English translation) (2 pages).

European Search Report dated Apr. 1, 2020, for European Patent Application No. 19206950.8 (10 pages).

Response to Office Action dated Aug. 9, 2021 for U.S. Appl. No. 16/711,703.

Search Result of examination report for German Patent Application No. 10 2018 132 075.2 filed Dec. 13, 2018.

* cited by examiner

METHOD FOR THE PRODUCTION OF A METAL STRIP COATED WITH A COATING OF CHROMIUM AND CHROMIUM OXIDE USING AN ELECTROLYTE SOLUTION WITH A TRIVALENT CHROMIUM COMPOUND

FIELD OF THE DISCLOSURE

The present disclosure relates to a method for the production of a metal strip coated with a coating of chromium and chromium oxide.

BACKGROUND

It is known from the prior art that in the production of packaging materials, electrolytically coated sheet steel, coated with chromium and chromium oxide, can be used, which sheet steel is known as tin-free steel ("Tin Free Steel" TFS) or as "Electrolytic Chromium Coated Steel" (ECCS) and which is an alternative to tinplate. This tin-free steel is marked by an especially favorable adhesion for paints or organic protective coatings (for example, polymer coatings of PP or PET). In spite of the low thickness of the coating of chromium and chromium oxide, which, as a rule, is less than 20 nm, this chromium-coated sheet steel is marked by good corrosion resistance and good workability in deformation processes used in the production of packaging materials, for example, in deep drawing processes and ironing processes.

To coat the steel substrate with a coating containing metallic chromium and chromium oxide, it is known from the prior art that electrolytic coating methods can be used, by means of which the coating is deposited on strip-shaped sheet steel using a chromium(VI)-containing electrolyte in a strip coating system. Due to the environmentally harmful and health-threatening properties of the chromium(VI)-containing electrolytes used in the electrolytic process, however, these coating methods are fraught with considerable disadvantages and will have to be replaced in the not too distant future with alternative coating methods since the use of chromium (VI)-containing materials will soon be prohibited.

For this reason, electrolytic coating methods, which obviate the use of chromium(VI) containing electrolytes, have already been developed in the state of the art. For example, WO 2015/177315-A1 discloses a method for the electrolytic coating of an electrically conductive substrate, which may specifically be tin-free steel (uncoated sheet steel) or tinplate (sheet steel coated with tin), with a chromium metal/chromium oxide (Cr/CrOx) layer, in which the substrate, connected as the cathode, is brought into contact with an electrolyte solution which contains a trivalent chromium compound (Cr(III)), with an anode being provided which suppresses, or at least reduces, the oxidation of chromium (III) ions to chromium(VI) ions, and in which hydrogen bubbles which form on the surface of the substrate during the electrolytic deposition are removed. In this context, it was observed that the separation reaction and the surface quality of the electrolytically deposited coating depend on the temperature of the electrolyte solution and that temperatures of the electrolyte solution between 30° C. and 70° C. are suitable for producing coatings with a good surface appearance. A preferred temperature range between 40° C. and 60° C. has been found to be favorable for ensuring an efficient deposition reaction, since at these temperatures, the electrolyte solution has good conductivity.

WO 2015/177314-A1 discloses a method for the electrolytic coating of strip-shaped sheet steel with a chromium metal/chromium oxide (Cr/CrOx) layer in a strip coating system in which the sheet steel, which is connected as the cathode, is passed at high strip travel speeds of more than 100 m/min through an electrolyte solution which contains a trivalent chromium compound (Cr(III)). It was observed that the composition of the coating—which, depending on the components besides the chromium metal and chromium oxide constituents contained in the trivalent chromium compound (Cr(III)) in the electrolyte solution, may, also contain chromium sulfates and chromium carbides—depends to a very large extent on the electrolysis current densities at the anodes that are set during the electrolytic deposition process in the electrolysis tanks in which the electrolyte solution is contained. It was found that as a function of the current density, three regions (Regime I, Regime II and Regime III) form, such that in a first region with a low current density up to a first current density threshold (Regime I), a chromium-containing deposition on the steel substrate does not take place; in a second region with medium current density (Regime II), there is a linear relationship between the current density and the weight of the deposited coating; and that at current densities above a second current density threshold (Regime III), a partial decomposition of the deposited coating takes place, so that in this region, as the current density increases, the coating weight of chromium in the deposited coating initially decreases and subsequently settles to a steady value at higher current densities. In the region with a medium current density (Regime II), mainly metallic chromium of up to 80 wt % (relative to the total weight of the coating) is deposited on the steel substrate, and above the second current density threshold (Regime III), the coating has a higher chromium oxide content, which in the region of the higher current densities amounts to between ¼ and ⅓ of the total deposited weight of the coating. The values of the current density thresholds which separate the regions (Regime I to III) from each other were found to be dependent on the strip travel speed at which the sheet steel is moved through the electrolyte solution.

As mentioned in WO 2014/079909 A1, to ensure that tin-free steel coated with a chromium/chromium oxide coating (sheet steel) has a sufficiently high corrosion resistance for use in packaging applications, a minimum coating weight of at least 20 mg/m$^2$ is required in order to achieve a corrosion resistance comparable to that of conventional ECCS. Furthermore, it was shown that to achieve a sufficiently high corrosion resistance suitable for use in packaging applications, the coating must have a minimum coating weight of chromium oxide of at least 5 mg/m$^2$.

SUMMARY

One aspect of the present disclosure relates to an efficient method possible for the production of metal strips coated with a coating of chromium and chromium oxide using an electrolyte solution with a trivalent chromium compound, which can be carried out on an industrial scale in a strip coating system, wherein the coating has a chromium oxide content as high as possible to ensure a sufficiently high corrosion resistance of the coated metal strip and a good adhesive base for organic coatings, for example, paints or polymer films of PET or PP.

Preferred embodiments of this method are disclosed.

According to the disclosed method, a coating containing chromium metal and chromium oxide is electrolytically deposited from an electrolyte solution that contains a trivalent chromium compound onto a metal strip, specifically a steel strip, by bringing the metal strip, which is connected as the cathode, into contact with the electrolyte solution, the metal strip being successively passed at a predefined strip travel speed in a strip travel direction through a plurality of electrolysis tanks which are successively arranged in the strip travel direction, wherein the electrolyte solution, at least in the last electrolysis tank, as viewed in the strip travel direction, or in a rear group of electrolysis tanks, has a temperature, averaged across the volume of the electrolyte tank(s), that does not exceed a maximum of 40° C., and the electrolysis time, during which the metal strip is in electrolytically effective contact with the electrolyte solution in the last electrolysis tank or in the rear group of electrolysis tanks is less than 2.0 seconds.

In this context, any reference to the temperature of the electrolyte solution or to the temperature in an electrolysis tank is intended to signify the mean temperature which results as the average of the overall volume of an electrolysis tank. As a rule, there is a temperature gradient with the temperature increasing from top to bottom in the electrolysis tanks. In this context, the term chromium oxide refers to all oxide forms of chromium (CrOx), including chromium hydroxides, in particular chromium(III) hydroxide and chromium(III) oxide hydrate, and mixtures thereof.

It was found that at temperatures of the electrolyte solution of 40° C. or lower, the formation of chromium oxide is promoted. At temperatures of the electrolyte solution of a maximum of 40° C., it is therefore possible to produce coatings with a higher chromium oxide content. A higher chromium oxide content in the coating is advantageous in that it improves the corrosion resistance of the coated metal strip. The proportion of chromium oxide in the coating can also be increased by ensuring a short electrolysis time of 2.0 seconds or less at least in the last electrolysis tank or in the rear group of electrolysis tanks. In addition, the short electrolysis time in the last electrolysis tank or in the rear group of electrolysis tanks allows the electrolytic coating method to be carried out in a continuous process in a strip coating system at high strip travel speeds, which are preferably higher than 100 m/min.

The electrolysis time, during which the metal strip is in electrolytically effective contact with the electrolyte solution, in each of the electrolysis tanks is preferably less than 2 seconds, so that the metal strip can be passed at a uniform strip travel speed through the plurality of electrolysis tanks, all of which are preferably identically designed and arranged one behind the other in the strip travel direction. At preferred strip travel speeds exceeding 100 m/min, the electrolysis time in each of the electrolysis tanks is preferably between 0.5 and 2.0 seconds, specifically from 0.6 seconds to 1.8 seconds. Depending on the strip travel speed used, the electrolysis time in each of the electrolysis tanks may also be between 0.3 and 2.0 seconds and preferably from 0.5 seconds to 1.4 seconds.

Depending on the number of electrolysis tanks, successively arranged in the strip travel direction, the total electrolysis time ($t_E$), during which the metal strip is in electrolytically effective contact with the electrolyte solution, across all electrolysis tanks, is preferably between 2 and 16 seconds and specifically between 4 seconds and 14 seconds.

For reasons of improved deposition efficiency, it may advantageous for the temperature of the electrolyte solution in the first electrolysis tank or in the front group of electrolysis tanks to be higher than in the last electrolysis tank. The temperature of the electrolyte solution in the first electrolysis tank or in the front group of electrolysis tanks is preferably higher than 50° C. and is specifically between 53° C. and 70° C., since in this temperature range a more efficient deposition of chromium, specifically in the form of chromium metal, can be observed. If the temperature of electrolyte solution in the first electrolysis tank or in the front group of electrolysis tanks is set higher than 50° C. and if, at the same time, the temperature of the electrolyte solution in the last electrolysis tank or in the rear group of electrolysis tanks is set lower than 40° C., it is possible to deposit a coating on the surface of the metal strip, which coating comprises at least one lower and one upper layer, with the lower layer being deposited in the first electrolysis tank or in the front group of electrolysis tanks and with the upper layer being deposited in the last electrolysis tank or in the rear group of electrolysis tanks, and with the lower layer containing a smaller portion of chromium oxide and with the upper layer containing a higher portion of chromium oxide. The proportion by weight of chromium oxide in the lower layer, which faces the surface of the metal strip, is preferably less than 15% and, in the upper layer, preferably higher than 40%.

However, for practical reasons, it may be useful to set the electrolyte solution in the electrolysis tanks to a uniform temperature, which (averaged across the volume of the respective electrolysis tank) is in all electrolysis tanks preferably between 20° C. and 40° C. and more preferably between 25° C. and 38° C.

Since the deposition process is exothermic, the electrolyte solution in the electrolysis tanks has to be cooled to ensure that the preferred temperatures are maintained. This is complicated by the fact that the circulation systems of the electrolysis tanks are generally interconnected. For reasons of equipment design and setup, it may therefore be useful to maintain the same temperature in all electrolysis tanks in order to avoid different settings, which would require a complex equipment setup. From a results-oriented standpoint, specifically with regard to an improved corrosion resistance of the coated metal strip, however, it is advantageous to set the temperature in the first electrolysis tank or in the front group of electrolysis tanks to a higher temperature than in the last electrolysis tank or in the rear group of electrolysis tanks.

For this reason, a preferred embodiment of the method according to the present disclosure provides that the metal strip be passed at least through a first electrolysis tank or a front group of electrolysis tanks and then through a second electrolysis tank or a rear group of electrolysis tanks, where the average temperature of the electrolyte solution in the first electrolysis tank or the front group of electrolysis tanks is higher than the average temperature of the electrolyte solution in the second electrolysis tank or the rear group of electrolysis tanks.

According to a second preferred embodiment, the metal strip is first passed through a first electrolysis tank or a front group of electrolysis tanks, then through a second electrolysis tank or a middle group of electrolysis tanks, and finally through a last electrolysis tank or a rear group of electrolysis tanks, where the average temperature of electrolyte solution in the first electrolysis tank or the front group of electrolysis tanks and/or in the second electrolysis tank or the middle group of electrolysis tanks is higher than the average temperature of the electrolyte solution in the last electrolysis tank or the rear group of electrolysis tanks.

The composition of the electrolytically deposited coating on the metal strip depends not only on the temperature of the electrolyte solution but also on the electrolysis current density. It has been demonstrated that at the higher current densities in the region of Regime III, where there is already a (partial) decomposition of the deposited coating, a higher proportion of chromium oxide is formed in the coating compared with the lower current densities in Regime II, where a linear relationship between the deposited coating weight of chromium and the current density is observed. To produce a coating with a lower layer that contains a high proportion of chromium metal and an upper layer that contains a high proportion of chromium oxide, which preferably accounts for more than 40 wt % of the total coating weight of the layer, it is therefore advantageous to apply a low current density $j_1$ and $j_2$ in the first electrolysis tank, as viewed in the strip travel direction, or in the front group of electrolysis tanks and, where applicable, in the second electrolysis tank, following in the strip travel direction, or in the middle group of electrolysis tanks, respectively, and to apply a high current density $j_3$ in the last electrolysis tank, as viewed in the strip travel direction, or in the rear group of electrolysis tanks in Regime III, where $j_1$ and $j_2$ are each lower than $j_3$, and where the low current densities $j_1$ and $j_2$ at a strip travel speed of, for example, 100 m/min are each higher than 20 A/dm$^2$ (and thus above the first current density threshold of approximately 20 A/dm$^2$, and therefore within the region of Regime II), and where the high current density $j_3$ is higher than 50 A/dm$^2$ (and thus above the second current density threshold, and therefore within the region of Regime III). Depending on the strip travel speed, the current densities $j_1$, $j_2$ and $j_3$ are increased, so that at a strip travel speed of 300 m/min, for example, the current densities $j_1$ and $j_2$ are greater than 70 A/dm$^2$ and the high current density $j_3$ is greater than 130 A/dm$^2$.

According to an especially preferred embodiment, the first electrolysis tank or the front group of electrolysis tanks, has a lower current density than the second electrolysis tank, following in the strip travel direction, or in the middle group of electrolysis tanks, so that 20 A/dm$^2$<$j_1 \leq j_2 < j_3$.

As a result, it is possible to deposit a coating that comprises three layers on the surface of the metal strip, each with a different composition with regard to its proportion of chromium metal and chromium oxide, with the lower layer, which faces the metal strip, having a medium weight portion of chromium oxide, which is specifically between 10% and 15%, with the middle layer having a low weight portion of chromium oxide, which is specifically between 2% and 10%, and with the upper layer having a high weight portion of chromium oxide, which, specifically, is higher than 30% and preferably higher than 50%. With regard to the adhesion of organic top coats, e.g., organic paints or polymer films of PET or PP, the layer with the high proportion of oxide is preferably on the outside surface since it has been demonstrated that chromium oxide, in comparison with chromium metal, forms a better adhesive base surface for organic materials.

By dividing the successively, in the strip running direction, arranged electrolysis tanks into groups and by setting different current densities that increase in the strip travel direction in the individual electrolysis tanks, high strip travel speeds of 100 m/min or more can be maintained, on the one hand, and a coating with a sufficiently high coating weight on at least one side of the metal strip can be deposited, on the other hand, with the coating having a proportion of chromium oxide of at least 5 mg/m$^2$, preferably of more than 7 mg/m$^2$, required to ensure a sufficiently high corrosion resistance. The total coating weight of chromium oxide preferably does not exceed 15 mg/m$^2$, since it has been observed that the adhesion of organic top coats of paints or thermoplastic polymer materials is reduced at higher coating weights of chromium oxide. For this reason, the coating weight of chromium oxide is preferably between 5 and 15 mg/m$^2$.

Due to the fact that the first electrolysis tank or the front group of electrolysis tanks, and the second electrolysis tank or the middle groups of electrolysis tanks, have respective current densities $j_1$ and $j_2$ lower than the current density of the last electrolysis tank, as viewed in the strip travel direction, or the rear group of electrolysis tanks, it is possible to save energy since lower currents are needed for application to the anodes in the first electrolysis tank or in the front group of electrolysis tanks and in the second electrolysis tank or in the middle group of electrolysis tanks. Despite this, however, the coating formed has a sufficiently high coating weight of chromium oxide, since even at the lower current densities $j_1$ and $j_2$, which are set in the first and in the second electrolysis tank and in the front and the middle group of electrolysis tanks, respectively, a certain amount of chromium oxide is already deposited on the metal substrate. The major portion of chromium oxide is deposited in the last electrolysis tank, as viewed in the strip travel direction, or in the rear group of electrolysis tanks, since these tanks are set to the high current density $j_3$ with which the proportion of chromium oxide relative to the total coating weight of the coating is higher.

Since already in the first electrolysis tank or in the front group of electrolysis tanks and in the second electrolysis tank or in the middle group of electrolysis tanks, a certain proportion by weight of the total deposition of the applied coating, which is approximately 9% to 15%, is attributable to chromium oxide, chromium oxide crystals form on the surface of the metal strip already in the first electrolysis tank or in the front group of electrolysis tanks and in the second electrolysis tank or in the middle group of electrolysis tanks. In the last electrolysis tank and/or in the rear group of electrolysis tanks, these chromium oxide crystals act as a nuclear cell for the growth of additional oxide crystals, which explains why the efficiency of the deposition of chromium oxide or, more specifically, the proportion of chromium oxide the total deposited weight of the coating increases in the last electrolysis tank or in the rear group of electrolysis tanks. Thus, while energy can be saved by using lower current densities $j_1$ and $j_2$ in the first and second electrolysis tank and in the front and middle group of electrolysis tanks, respectively, it is possible to produce a sufficiently high coating weight of chromium oxide of preferably more than 5 mg/m$^2$ on the surface of the metal strip.

Due to the oxygen content of the coating, which is higher than that obtained during the electrolytic deposition at higher current densities (and, consequently, a lower oxide content), the proportion of chromium oxide generated in the first electrolysis tank or in the front group of electrolysis tanks and in the second electrolysis tank or in the middle group of electrolysis tanks forms a denser coating, which leads to improved corrosion resistance.

The use of at least two, preferably three, successively arranged electrolysis tanks, or groups of electrolysis tanks, makes it possible to maintain a high strip travel speed at current densities as low as possible, which increases the efficiency of the process. It has been demonstrated that to maintain a preferred strip travel speed of at least 100 m/min, a current density of at least 20 A/dm$^2$ is required for a deposition of a chromium/chromium oxide layer to take place at least on one surface of the metal strip. This current density of 20 A/dm$^2$ represents the first current density threshold at a strip travel speed of approximately 100 m/min, which threshold separates Regime I (no chromium deposition) from Regime II (chromium deposition where there is a linear relationship between current density and the coating weight of chromium of the deposited coating).

The current densities ($j_1$, $j_2$, $j_3$) in the electrolysis tanks are each adjusted to the strip travel speed, wherein at least substantially a linear relationship between the strip travel speed and the respective current density ($j_1$, $j_2$, $j_3$) exists. It is advantageous if the current density in the first electrolysis tank or in the front group of electrolysis tanks is lower than in the second electrolysis tank or in the middle group of electrolysis tanks. A lower current density in the first electrolysis tank or in the front group of electrolysis tanks generates a dense and therefore corrosion-resistant chromium/chromium oxide coating with a relatively high chromium oxide content, which is preferably greater than 8%, specifically between 8% and 15%, and more preferably greater than 10 wt %, directly on the surface of the metal strip.

To generate the current densities ($j_1$, $j_2$, $j_3$) in the electrolysis tanks, preferably a pair of anodes with two anodes arranged opposite to one another is disposed in each electrolysis tank, with the metal strip passing between the opposite anodes of a pair of anodes. This allows the current density to be uniformly distributed around the metal strip. Here, it is preferable if current is applied to the pair of anodes of each electrolysis tank independently of each other, thereby allowing different current densities ($j_1$, $j_2$, $j_3$) to be set in the electrolysis tanks.

The strip travel speed of the metal strip is preferably such that in each of the electrolysis tanks, the electrolysis time ($t_E$), during which the metal strip is in electrolytically effective contact with the electrolyte solution, is less than 1.0 second, specifically between 0.5 and 1.0 seconds and preferably between 0.6 seconds and 0.9 seconds.

To ensure that the coated metal strip has sufficiently high corrosion resistance, the coating deposited on the metal strip by means of the method according to the present disclosure preferably has a coating weight of chromium of at least 40 mg/m$^2$, specifically between 70 mg/m$^2$ and 180 mg/m$^2$. The proportion by weight of the chromium oxide contained in the coating relative to the total weight of the coating amounts to at least 5%, specifically to more than 10%, and is, for example, between 11% and 16%. Here, the chromium oxide content of the coating has a deposited weight of chromium bound as chromium oxide of at least 3 mg of Cr per m$^2$, specifically between 3 and 15 mg/m$^2$, and preferably of at least 7 mg of Cr per m$^2$.

In the method according to the present disclosure, preferably a single electrolyte solution is used, i.e., all of the electrolysis tanks are filled with the same electrolyte solution.

A preferred composition of the electrolyte solution comprises basic Cr(III) sulfate ($Cr_2(SO_4)_3$) as a trivalent chromium compound. Both in this preferred composition and in other compositions, the concentration of the trivalent chromium compound in the electrolyte solution is at least 10 g/L and preferably higher than 15 g/L and specifically 20 g/L or higher. Other useful constituents of the electrolyte solution may include complexing agents, in particular an alkali metal carboxylate, preferably a salt of formic acid, in particular potassium formate or sodium formate. The ratio of the proportion by weight of the trivalent chromium compound to the proportion by weight of the complexing agents, in particular the formates, is preferably between 1:1.1 and 1:1.4 and more preferably between 1:1.2 and 1:1.3 and is specifically 1:1.25. To increase the conductivity, the electrolyte solution may contain an alkali metal sulfate, preferably potassium sulfate or sodium sulfate. The electrolyte solution is preferably free of halides, specifically free of chloride ions and bromide ions, and free of a buffering agent and specifically free of a boric acid buffer.

The pH value of the electrolyte solution (measured at a temperature of 20° C.) is preferably between 2.0 and 3.0 and more preferably between 2.5 and 2.9 and is specifically 2.7. To adjust the pH value of the electrolyte solution, an acid, for example, sulfuric acid, can be added to the solution.

Following the electrolytic deposition of the coating, an organic coating, specifically a paint or a thermoplastic material, for example, a polymer film of PET, PE, PP or a mixture thereof, can be applied to the surface of the coating of chromium metal and chromium oxide so as to provide additional protection against corrosion and a barrier against acid-containing filling agents contained in packaging materials.

The metal strip involved can be a (initially uncoated) steel strip (tin-free steel strip) or a steel strip coated with tin (tinplate strip).

BRIEF DESCRIPTION OF THE DRAWINGS

The present disclosure will be described in greater detail with reference to the appended drawings and based on the following embodiment examples, which are merely intended to explain the disclosure by way of example, without in any way limiting the scope of protection defined by the following claims. The drawings show:

DETAILED DESCRIPTION

Figure 1:
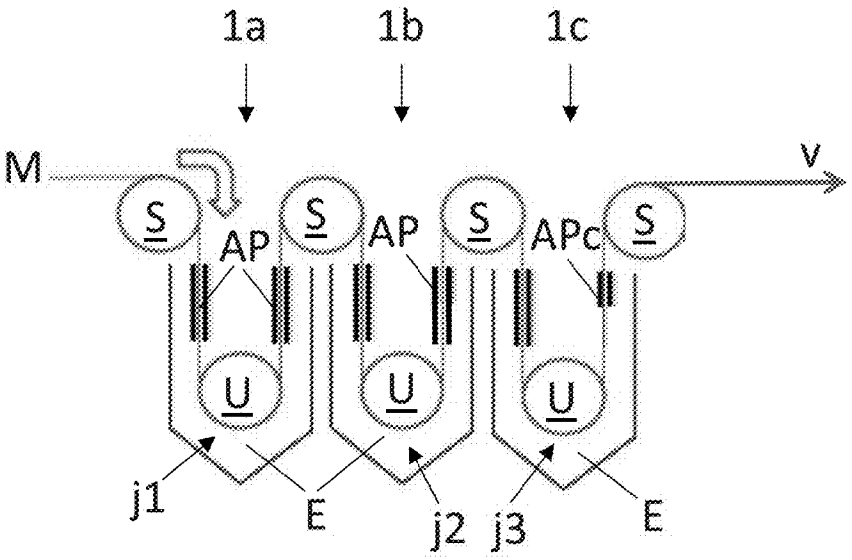
FIG. 1: a diagrammatic representation of a strip coating system for carrying out the method disclosed by the present disclosure in a first embodiment with three electrolysis tanks which are successively arranged in the strip travel direction v.

FIG. 1 shows a diagrammatic representation of a strip coating system for carrying out the method disclosed by the present disclosure in a first embodiment. The strip coating system comprises three electrolysis tanks 1*a*, 1*b*, 1*c*, which are arranged side by side or one after another and which are each filled with an electrolyte solution E. An initially uncoated metal strip M, specifically a steel strip, is successively passed through the electrolysis tanks 1*a*-1*c*. To this end, by means of a conveyor device (not shown), the metal strip M is pulled at a predefined strip travel speed through the electrolysis tanks 1*a*-1*c* in the strip travel direction v. Disposed above the electrolysis tanks 1*a*-1*c* are current rolls S, by means of which the metal strip M is connected as the cathode. Also disposed in each electrolysis tank is a guide roller U, around which the metal strip M is guided and thereby moved into and out of the electrolysis tank.

Within each electrolysis tank 1*a*-1*c*, at least one anode pair AP is disposed below the liquid level of the electrolyte solution E. In the embodiment example shown, two anode pairs AP successively arranged in the strip travel direction are disposed in each electrolysis tank 1*a*-1*c*. The metal strip M is passed through and between the opposing anodes of an anode pair AP. Thus, in the embodiment example of FIG. 1, two anode pairs AP are arranged in each electrolysis tank 1*a*, 1*b*, 1*c* such that the metal strip M is successively passed through these anode pairs AP. The last downstream anode pair APc of the last electrolysis tank 1*c*, as viewed in the strip travel direction v, has a shorter length compared with the lengths of the other anode pairs AP. As a result, a higher current density can be generated with this last anode pair APc with application of the same quantity of electric current.

The metal strip M involved can be a cold-rolled, initially uncoated steel strip (tin-free steel strip) or a steel strip coated with tin (tinplate strip). In preparation for the electrolysis process, the metal strip M is first degreased, rinsed, pickled and rinsed again, and in this pretreated form, it is subsequently successively passed through the electrolysis tanks 1*a*-1*c*, with the metal strip M being connected as the cathode by supplying electric current via the current rolls S. The strip travel speed with which the metal strip M is passed through the electrolysis tanks 1*a*-1*c* is at least 100 m/min and can be up to 900 m/min.

The electrolysis tanks 1*a*-1*c*, which are successively arranged in the strip travel direction v, are each filled with the same electrolyte solution E. The electrolyte solution E contains a trivalent chromium compound, preferably basic Cr(III) sulfate [$Cr_2(SO_4)_3$]. In addition to the trivalent chromium compound, the electrolyte solution preferably also contains at least one complexing agent, for example, a salt of formic acid, in particular potassium formate or sodium formate. The ratio of the proportion by weight of the trivalent chromium compound to the proportion by weight of the complexing agents, specifically the formates, is preferably between 1:1.1 and 1:1.4 and is most preferably 1:1.25. To increase conductivity, the electrolyte solution E may contain an alkali metal sulfate, for example, potassium sulfate or sodium sulfate. The concentration of the trivalent chromium compound in the electrolyte solution E is at least 10 g/L and most preferably 20 g/L or more. The pH value of the electrolyte solution is adjusted to a preferred value between 2.0 and 3.0 and specifically to pH=2.7 by the addition of an acid, for example, sulfuric acid.

The temperature of the electrolyte solution E can be the same in all electrolysis tanks 1*a*-1*c* and according to the present disclosure is at most 40° C. However, in preferred embodiment examples of the method according to the present disclosure, it is possible to set the temperatures of the electrolyte solution in the electrolysis tanks 1*a*-1*c* to different settings. For example, the temperature of the electrolyte solution of the last electrolysis tank 1*c* can be at most 40° C., and that of the electrolysis tanks 1*a* and 1*b* disposed upstream thereto may be higher. In this embodiment of the method according to the present disclosure, the temperature of the electrolyte solution of the last electrolysis tank 1*c* is preferably between 25° C. and 37° C. and is specifically 35° C. In this embodiment example, the temperature of the electrolyte solution of the first two electrolysis tanks 1*a*, 1*b* is preferably between 50° C. and 75° C. and is specifically 55° C. Due to the lower temperature of the electrolyte solution E, the deposition of a chromium/chromium oxide layer with a higher chromium oxide content is promoted in the electrolysis tank 1*c*.

Figure 5:
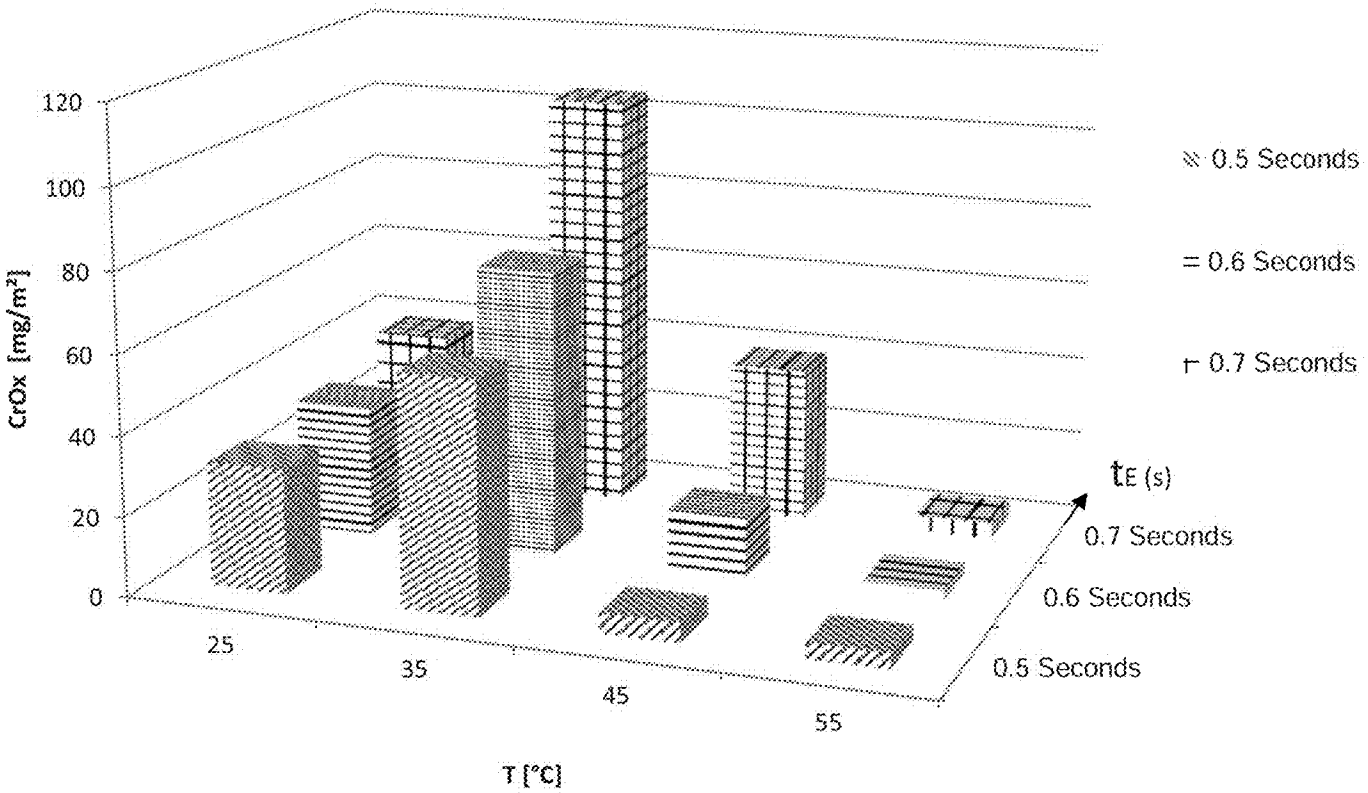
FIG. 5: a graphical representation of the deposited weight of a coating, which has been applied to a metal strip and which contains chromium metal and chromium oxide, as a function of the temperature of the electrolyte solution and the electrolysis time.

This is clearly illustrated by the diagram of FIG. 5 which shows the coating weight of the chromium oxide portion (CrOx in mg/m$^2$) of a coating B, which has been deposited on the metal strip, as a function of the temperature (T in ° C.) of the electrolyte solution and the electrolysis time ($t_E$ in seconds). The diagram shows that within a predefined electrolysis time (for example, of $t_E$=0.5 seconds), a higher coating weight of chromium oxide (CrOx) is deposited at temperatures T less than 40° C. than at higher temperatures. At a temperature T of approximately 35° C. of the electrolyte solution, a peak in the coating weight of chromium oxide is observed. This indicates that in the temperature range according to the disclosure of up to 40° C. and preferably between 20° C. and 40° C., the deposition of coatings with a high chromium oxide portion is promoted.

FIG. 5 also illustrates that the coating weight of chromium oxide increases with the electrolysis time $t_E$. In order to create a strip coating method that is as efficient as possible which can be carried out at as high a strip travel speed as possible, preferably more than 100 m/min, short electrolysis times of less than 2 seconds in each of the electrolysis tanks 1*a*-1*c* are preferred. The diagram of FIG. 5 also shows that even at short electrolysis times of less than 1 second, sufficiently high coating weights of chromium oxide of more than 20 mg/m$^2$ can be obtained if the temperature of the electrolyte solution is within the range according to the disclosure of 40° C. or less and specifically between 20° C. and 38° C.

Depending on the strip travel speed, during an electrolysis time $t_E$, the metal strip M, which is connected as the cathode and which is passed through electrolysis tanks 1*a*-1*c*, is in electrolytically effective contact with the electrolyte solution E. At strip travel speeds between 100 and 700 m/min, the electrolysis time in each of the electrolysis tanks 1*a*, 1*b*, 1*c* is preferably between 0.5 and 2.0 seconds. According to the present disclosure, to ensure a high coating efficiency and a high throughput, strip travel speeds are set sufficiently high that the electrolysis time $t_E$ in each electrolysis tank 1*a*, 1*b*, 1*c* is less than 2 seconds and is specifically between 0.6 seconds and 1.8 seconds. Accordingly, the total electrolysis time, during which the metal strip M is in electrolytically effective contact with the electrolyte solution E across all electrolysis tanks 1*a*-1*c*, is between 1.8 and 5.4 seconds.

The anode pairs AP disposed in the electrolysis tanks 1*a*-1*c* can be supplied with direct current such that there is the same current density in each of the electrolysis tanks 1*a*, 1*b*, 1*c*. However, to deposit a coating B comprising a plurality of layers B1, B2, B3, each having a different composition, on the metal strip M, it is also possible to use different current densities in the electrolysis tanks 1*a*, 1*b*, 1*c*. For example, in the upstream, first electrolysis tank 1*a*, as viewed in the strip travel direction v, a low current density $j_1$ can be set; in the downstream, following second electrolysis tank 1*b*, a medium current density $j_2$ can be set; and in the downstream, last electrolysis tank 1*c*, a high current density $j_3$ can be set, where $j_1<j_2<j_3$ and the low current density $j_1>20$ A/dm$^2$.

Due to the current densities set in the electrolysis tank 1*a*-1*c*, a chromium metal- and chromium oxide-containing layer is electrolytically deposited on at least one side of the metal strip M, thereby generating layers B1, B2, B3 in the respective electrolysis tanks 1*a*, 1*b*, 1*c*. Due to the different current densities $j_1$, $j_2$, $j_3$ in the individual electrolysis tanks 1*a*, 1*b*, 1*c*, each electrolytically deposited layer B1, B2, B3 has a different composition, which differs in terms of the proportion of chromium oxide.

Figure 3:
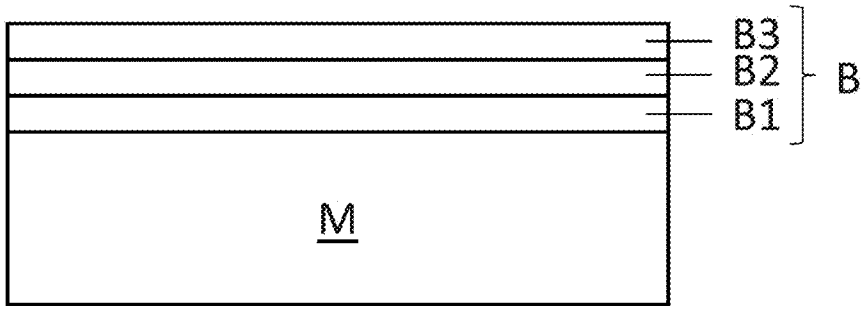
FIG. 3: a sectional view of a metal strip coated by means of the method disclosed by the present disclosure in a first embodiment.
Figure 4:
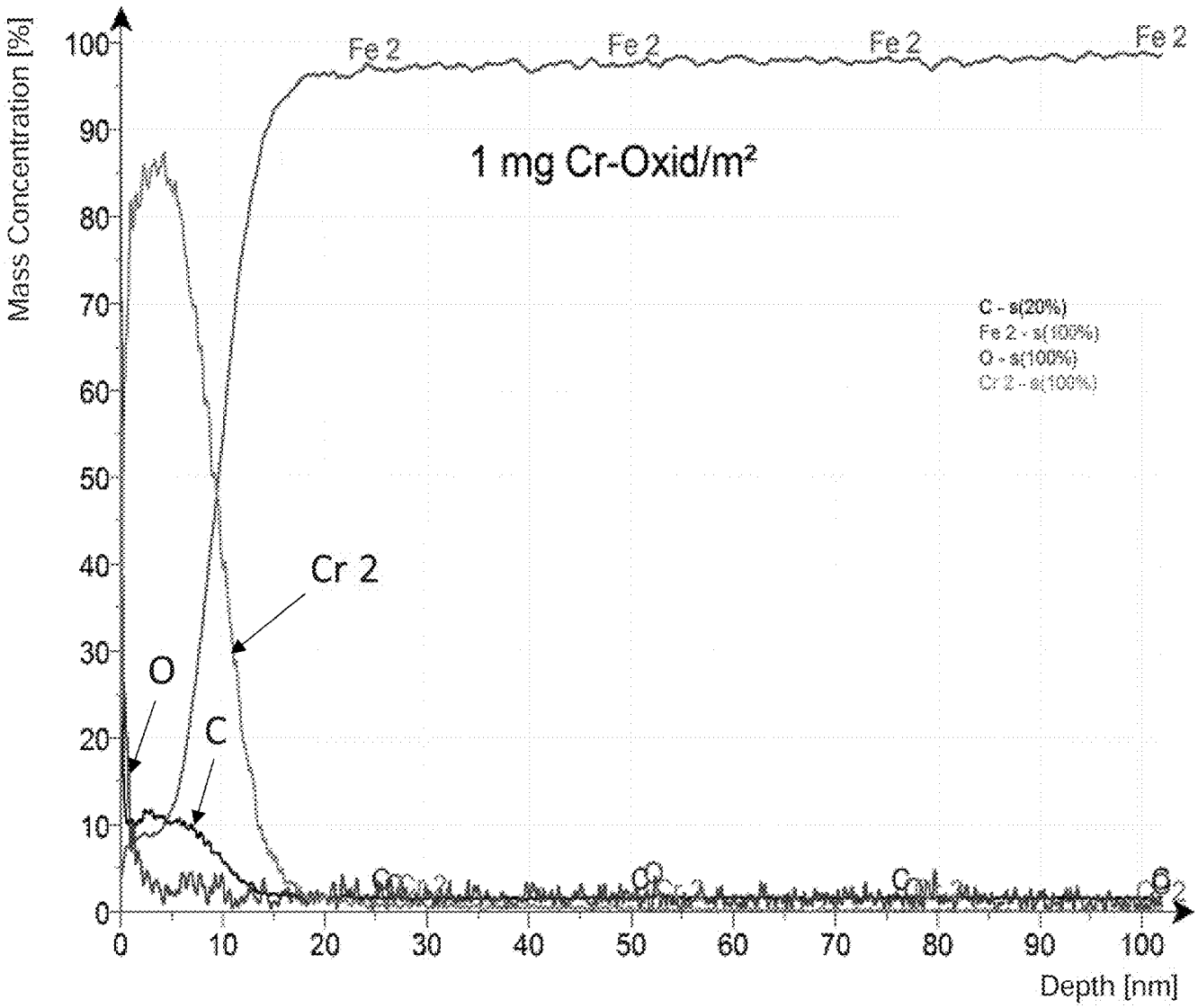
FIG. 4: a GDOES spectrum of a layer electrolytically deposited on a steel strip and containing chromium metal, chromium oxide and chromium carbides, where the chromium oxide is located on the layer surface.

FIG. 3 diagrammatically shows a sectional view of a metal strip M which has been electrolytically coated on one side using the method according to the present disclosure. On one side of the metal strip M, a coating B, composed of the individual layers B1, B2, B3, is deposited. Each individual layer B1, B2, B3 is applied to the surface in one of the electrolysis tanks 1*a*, 1*b*, 1*c*.

The coating B, which is composed of the individual layers B1, B2, B3, contains metallic chromium (chromium metal) and chromium oxides (CrOx) as its major constituents, where each of the individual layers B1, B2, B3, due to the different respective current densities $j_1$, $j_2$, $j_3$ of the electrolysis tanks 1*a*, 1*b*, 1*c*, has a different composition with regard to its respective proportion by weight of chromium metal and chromium oxide. Another factor that may contribute to the differing composition of the individual layers is the different temperatures of the electrolyte solution of the individual electrolysis tanks 1*a*, 1*b*, 1*c* since (as explained above with reference to FIG. 5) at temperatures lower than 40° C., the formation of chromium oxide is promoted. To obtain a layer B3 with the highest possible oxide content, a high current density $j_3$ (higher than the current density $j_1$, $j_2$ in the upstream electrolysis tanks) and, at the same time, an electrolyte solution temperature below 40° C. are preferably set for the last electrolysis tank 1*c*.

Due to the low current density $j_1$ in the first electrolysis tank 1*a*, the layer B1 deposited in the first electrolysis tank 1*a* has a higher oxide content compared to the layer B2 deposited in the second (middle) electrolysis tank 1*b*, since the lower current densities which occur in Regime II produce higher oxide levels in the coating. In the last electrolysis tank 1*c*, a current density $j_3$ is set which falls within Regime III, in which an increased proportion of chromium oxide is produced in the coating, which is preferably greater than 40 wt % and more preferably greater than 50 wt %.

By way of an example, Table 1 lists suitable current densities $j_1$, $j_2$, $j_3$ in the individual electrolysis tanks 1*a*, 1*b*, 1*c* at different strip travel speeds. As Table 1 indicates, the current densities $j_1$ in the first electrolysis tank 1*a* are slightly lower than the current densities $j_2$ in the second electrolysis tank 1*b* and are above a lower limit value of $j_0$=20 A/dm$^2$. The current densities $j_1$, $j_2$ in the first two electrolysis tanks 1*a*, 1*b* are the current densities of Regime II in which there is a linear relationship between current density and the amount of electrolytically deposited chromium (or the coating weight of chromium in the deposited coating). The current density $j_1$ used in the first electrolysis tank 1*a* is preferably such that it is close to the first current density threshold, which separates Regime I (in which no deposition of chromium takes place) from Regime II. At these low current densities $j_1$, a chromium metal/chromium oxide coating (layer B1) is deposited on the surface of the metal strip M with a higher chromium oxide content than that generated at higher the current densities of Regime II. Therefore, the layer B1, which is deposited in the first electrolysis tank 1*a*, has a higher chromium oxide content than the layer B2, which is deposited in the second electrolysis tank 1*b*.

In the last electrolysis tank 1*a*, the current density $j_3$ is preferably set such that it is above the second current density threshold which separates Regime II from Regime III. The current density $j_3$ of the last electrolysis tank 1*c* is thus in Regime III, in which a partial decomposition of the chromium metal/chromium oxide coating takes place and a considerably higher pro portion of chromium oxide is deposited than at the current densities of Regime II. Therefore, the coating B3, which is deposited in the last electrolysis tank 1*c*, has a high chromium oxide content which is greater than the chromium oxide content of the coatings B1 and B2. Following the electrolytic deposition of the coating, the metal strip M coated with the coating B is rinsed, dried and oiled (for example, with DOS oil). Subsequently, an organic cover coat can be applied to the surface of the coating B on the metal strip M, which has been electrolytically coated with the coating B. The organic cover coat involved may be, for example, an organic paint or polymer films of thermoplastic polymers, such as PET, PP, PE or mixtures thereof. The organic cover coat can be applied by means of a coil coating method or a panel coating method, with the coated metal strip in the panel coating method first being divided into panels which are subsequently painted with an organic paint or coated with a polymer film.

Figure 2:
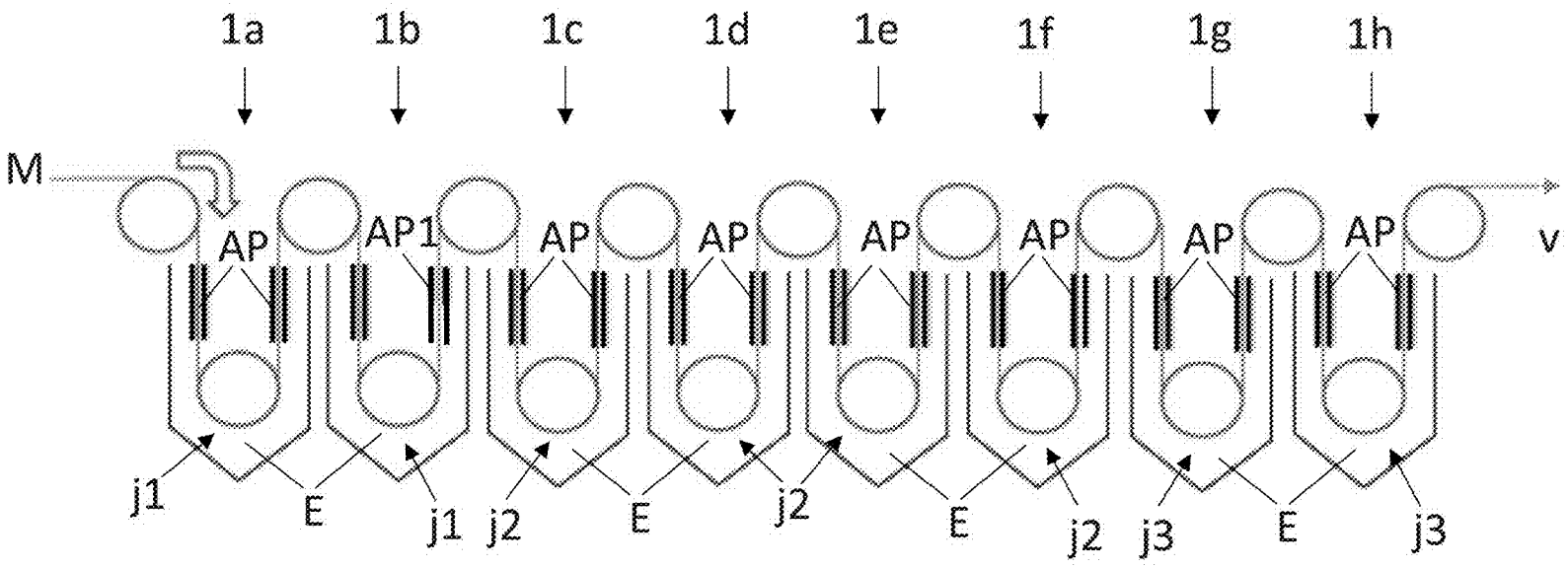
FIG. 2: a diagrammatic representation of a strip coating system for carrying out the method disclosed by the present disclosure in a second embodiment with eight electrolysis tanks which are successively arranged in the strip travel direction v.

FIG. 2 shows a second embodiment of a strip coating system with eight electrolysis tanks 1*a*-1*h* which are successively arranged in the strip travel direction v. The electrolysis tanks 1*a*-1*h* are arranged in three groups, i.e., a front group with the first two electrolysis tanks 1*a*, 1*b*; a middle group with the electrolysis tanks 1*c*-1*f*, which follow in the strip travel direction, and a rear group with the two last electrolysis tanks 1*g* and 1*h*. According to the present disclosure, in the rear group of the electrolysis tanks 1*g* and 1*h*, the temperature of the electrolyte solution is 40° C. or less. In the front group with the first two electrolysis tanks 1*a*, 1*b* and the middle group with the electrolysis tanks 1*c*-1*f*, either the same, or at least approximately the same, temperature, or a higher temperature can be present. To increase the deposition efficiency, temperatures higher than 50° C. and specifically a temperature of approximately 55° C. in the electrolysis tanks 1*a*, 1*b* of the front group and in the electrolysis tanks 1*c*-1*f* of the middle group are to be preferred. However, for practical reasons, it may be useful to set all of the electrolysis tanks 1*a* to 1*h* to the same temperature and to maintain this temperature by cooling the electrolyte solution during the electrolysis process.

The groups of electrolysis tanks preferably have different current densities $j_1$, $j_2$, $j_3$, wherein the front group of electrolysis tanks 1*a*, 1*b* has a low current density $j_1$, the middle group of electrolysis tanks 1*c*-1*f* has a medium current density $j_2$, and the rear group of electrolysis tanks 1*g*, 1*h* has a high current density $j_3$, where $j_1<j_2<j_3$ and the low current density $j_1$>20 A/dm$^2$.

Like Table 1, Table 2 lists exemplary and suitable current densities $j_1$, $j_2$, $j_3$ in the individual electrolysis tanks 1*a* to 1*h* at different strip travel speeds v, wherein the electrolysis tanks 1*a*, 1*b* of the front group are set to a low current density $j_1$, the electrolysis tanks 1*c* to 1*f* of the middle group are set to a medium current density $j_2$, and the electrolysis tanks 1*g*, 1*h* of the last group are set to a high current density $j_3$, where $j_1<j_2<j_3$.

In the front group of electrolysis tanks 1*a*, 1*b*, in the second group of electrolysis tanks 1*c*-1*f*, and in the rear group of electrolysis tanks 1*g*, 1*h*, chromium- and chromium oxide-containing first layer B1, second layer B2, and third layer B3 are respectively electrolytically deposited on the metal strip M. As in the embodiment example of FIG. 1, due to the different current densities $j_1$, $j_2$, $j_3$ and, where applicable, different temperatures in the successively arranged groups of electrolysis tanks, the layers B1, B2, B3 have different compositions, where the layer B1 contains a higher proportion of chromium oxide than the second layer B2, and the third layer B3 contains a higher chromium oxide portion than the two layers B1 and B2.

Thus, the coating B deposited on the surface of the metal strip M by means of the method of the disclosure with the strip coating system of FIG. 2 has substantially the same composition and structure, as shown in FIG. 3.

In the embodiment example of FIG. 2, the total electrolysis time, during which the metal strip M is in electrolytically effective contact with the electrolyte solution E across all electrolysis tanks 1*a*-1*h*, is preferably less than 16 seconds and is specifically between 4 and 16 seconds.

Since the strip coating system of FIG. 2 comprises a larger number of electrolysis tanks, which is necessarily associated with an increase in the total electrolysis time, during which the metal strip, which is connected as the cathode, is in electrolytically effective contact with the electrolyte solution E, it is possible to produce coatings B with higher coating weights.

To achieve a sufficiently high corrosion resistance, the total weight of chromium deposited in the coatings B is preferably at least 40 mg/m$^2$ and more preferably between 70 mg/m$^2$ and 180 mg/m$^2$. The proportion of chromium oxide contained in the total weight of deposited chromium, averaged across the total weight of the coating B, is at least 5% and is preferably between 10% and 15%. Overall, the coating B preferably has a chromium oxide content with a deposited weight of chromium bound as chromium oxide of at least 3 mg of chromium per m$^2$ and specifically between 3 and 15 mg/m$^2$. The deposited weight of chromium bound as chromium oxide, averaged across the total surface area of the coating B, is at least 7 mg of chromium per m$^2$. Good adhesion of organic paints or thermoplastic polymer materials to the surface of the coating B can be achieved with chromium oxide weights of up to approximately 15 mg/m$^2$. At higher coating weights of chromium oxide, the adhesion of organic top coats such as paints or polymer films deteriorates. Therefore, a preferred range for the coating weight of chromium oxide in the coating B is between 5 and 15 mg/m$^2$.

EXAMPLES

To explain how to implement the present disclosure, laboratory tests, in which sheet steel was coated with a chromium/chromium oxide coating, will be described in detail below:

Table 3 lists an example of the composition of an electrolyte solution which contains a Cr(III) salt ($Cr_2(SO_4)_3$) and which was used in coating tests in a laboratory apparatus for the electrolytic coating of a metal strip. The parameters of the electrolyte solution used are listed in Table 4. The Cr(III) salt used as a constituent of the electrolyte solution should be as free of any organic residues as possible. The Cr(III) salts can be produced on an industrial scale by means of a reduction of Cr(VI) salts. The reducing agent used is preferably a metal more reactive than chromium (variant 1) or, as an alternative, an organic component (variant 2). The pH value of the electrolyte solution was adjusted by the addition of sulfuric acid, followed by filling with deionized water.

The substrate used in the coating tests was sheet steel that had already been coated with a chromium/chromium oxide layer. This material was electrolytically coated with a chromium(III) electrolyte at 55° C., and Table 5 below describes the chromium metal and chromium oxide coating already existing on the sheet steel. It shows that mainly chromium metal and only a small amount of chromium oxide was produced.

The determination of chromium metal was carried out according to EURO Norm EN 10202 (Cr metal, photometric (Euro Norm) step 2: 120 mL $NaCO_3$ and 15 mA/plane; successful dissolution visible by potential step, oxidation with 10 mL 6% $H_2O_2$, photometric @ 370 nm). The determination of chromium oxide was also carried out according to EURO Norm EN 10202 (Cr oxides, photometric: (Euro Norm) step 1: 40 mL NaOH (330 g/L), reaction at 90° C. for 10 minutes, oxidation with 10 mL 6% $H_2O_2$, photometric @ 370 nm).

In preparation for the laboratory coating, the substrate was degreased (2.5 A/dm$^2$ connected as the cathode, 30 sec, 70° C. in sodium hydroxide solution) and subsequently rinsed with deionized water. Due to the already existing coating on the metal, the pickling step was not carried out.

Coating Parameters and Results:

Tables 6 and 7 summarize the parameters and the results of the coating tests. An industrial scale coating of a steel strip was simulated at a strip travel speed of 100 m/min. At this speed, the current density of 60 A/dm$^2$ used and steadily maintained throughout the test is that of Regime III (see Table 2) and thus generates (at least at the lower temperatures) mainly chromium oxide. In the laboratory tests, both the temperatures of the electrolyte solutions and the dwell times (electrolysis times) in Regime III were varied. In all tests, the lower surface of the substrate was coated. In Table 6, the electrolysis time in Regime III is given as "Time (s) Segment 1.

It can be observed that at temperatures of the electrolyte solution in the range of 22° C. to approximately 37° C., there is an increase in the chromium oxide content of the coating, and at temperatures from approximately 40° C., there is a considerably smaller proportion of chromium oxide in the coating. To obtain chromium-containing coatings with a high proportion of chromium oxide, according to the present disclosure, electrolyte temperatures of a maximum of 40° C. are therefore used. In order to produce a coating which has the highest possible chromium oxide content on the surface, coating according to the disclosure therefore takes place at electrolyte temperatures below 40° in the last electrolysis tank or in a rear group of electrolysis tanks.

In laboratory tests, the electrolysis times in the respective regime (segment) were less than 2 seconds. With increasing electrolysis times, higher coating weights of oxide were observed in the laboratory tests. However, with regard to the deposition efficiency in processes carried out on an industrial scale, short electrolysis times of less than 2 seconds are to be preferred since the strip travel speeds preferably used in such processes exceed 100 m/min.

TABLE 1

Current densities $j_1$, $j_2$, $j_3$ in the individual electrolysis tanks of the first embodiment example (with 3 electrolysis tanks 1a-1c) at different strip travel speeds v:

| | Tank | | |
|---|---|---|---|
| v [m/min] | 1a $J_1$/ [A/dm$^2$] | 1b $J_2$/ [A/dm$^2$] | 1c $J_3$/ [A/dm$^2$] |
| 100 | 25 | 29 | 75 |
| 150 | 41 | 45 | 91 |
| 200 | 57 | 61 | 107 |
| 300 | 73 | 77 | 133 |
| 400 | 89 | 93 | 149 |
| 500 | 105 | 109 | 165 |

TABLE 2

Current densities $j_1$, $j_2$, $j_3$ in the individual electrolysis tanks of the second embodiment example (with 8 electrolysis tanks 1a-1h which are divided into three groups) at different strip travel speeds v:

| Tank v [m/min] | 1a $J_1$/[A/dm$^2$] | 1b $J_1$/[A/dm$^2$] | 1c $J_2$/[A/dm$^2$] | 1d $J_2$/[A/dm$^2$] | 1e $J_2$/[A/dm$^2$] | 1f $J_2$/[A/dm$^2$] | 1g $J_3$/[A/dm$^2$] | 1h $J_3$/[A/dm$^2$] |
|---|---|---|---|---|---|---|---|---|
| 100 | 25 | 25 | 29 | 29 | 29 | 29 | 75 | 75 |
| 150 | 41 | 41 | 45 | 45 | 45 | 45 | 91 | 91 |
| 200 | 57 | 57 | 61 | 61 | 61 | 61 | 107 | 107 |
| 300 | 73 | 73 | 77 | 77 | 77 | 77 | 133 | 133 |
| 400 | 89 | 89 | 93 | 93 | 93 | 93 | 149 | 149 |
| 500 | 105 | 105 | 109 | 109 | 109 | 109 | 165 | 165 |

TABLE 3

Composition of the electrolyte solution

| Substance | Amount used/L |
|---|---|
| Sodium formate | 41.4 g |
| basic chromium sulfate | 120 g |
| Sulfuric acid 96% | ~7.5 ml |
| Sodium sulfate | 100 g |

TABLE 4

Parameters of the electrolyte solution

| Consecutive No. | Production date | Temperature in TCCT tank [° C.] | pH value VA08 | Conductivity VA08 [mS/cm] | pH value (55° C.) | Conductivity 55° C. [mS/cm] | Chromium concentration in the electrolyte (g/L) | Iron concentration in the electrolyte (mg/L) | Chloride concentration in the electrolyte (mg/L) | Electrolyte surface explosion 1. Cycle at −55° C. (μC/cm$^2$) | Electrolyte surface explosion 2. Cycle at −55° C. (μC/cm$^2$) |
|---|---|---|---|---|---|---|---|---|---|---|---|
| 13 | Feb. 28, 2018 | 55 | 2.4 | 88.5 | 2.3 | 158.3 | 22.6 | 270 | 182 | 348.8 | 327.8 |

TABLE 5

Determination of chromium metal and chromium oxide in the substrate

| Consecutive No. | Ø Chromium metal on upper surface (mg/m$^2$) | Ø Chromium metal on lower surface (mg/m$^2$) | Ø Chromium oxide on upper surface (mg/m$^2$) | Ø Chromium oxide on lower surface (mg/m$^2$) |
|---|---|---|---|---|
| 11 | 63 | 111 | 3 | 1 |

TABLE 6

Coating parameters

| Coating sequence | Speed [m/min] | Temperature, nominal [° C.] | Temperature, actual, coating [° C.] | Current density [A/dm$^2$] Segment 1 | Time [s] Segment 1 |
|---|---|---|---|---|---|
| 1 | 100 | 25 | 24.8 | 60.0 | 0.5 |
| 2 | 100 | 25 | 24.8 | 60.0 | 0.6 |
| 3 | 100 | 25 | 24.7 | 60.0 | 0.7 |
| 4 | 100 | 35 | 35.6 | 60.0 | 0.5 |
| 5 | 100 | 35 | 37.2 | 60.0 | 0.6 |
| 6 | 100 | 35 | 36.1 | 60.0 | 0.7 |
| 7 | 100 | 45 | 46.6 | 60.0 | 0.5 |
| 8 | 100 | 45 | 46.0 | 60.0 | 0.6 |

TABLE 6-continued

Coating parameters

| Coating sequence | Speed [m/min] | Temperature, nominal [° C.] | Temperature, actual, coating [° C.] | Current density [A/dm$^2$] Segment 1 | Time [s] Segment 1 |
|---|---|---|---|---|---|
| 9 | 100 | 45 | 45.1 | 60.0 | 0.7 |
| 10 | 100 | 55 | 55.2 | 60.0 | 0.5 |
| 11 | 100 | 55 | 55.3 | 60.0 | 0.6 |
| 12 | 100 | 55 | 55.5 | 60.0 | 0.7 |

TABLE 7

Analysis of the coating

| pH value prior to coating | Temperature during the pH value measurement | Cr oxide coating weight (photometric) [mg/m$^2$] | Cr metal coating weight (electrochemical) [mg/m$^2$] | Actual total CR coating weight [mg/m$^2$] |
|---|---|---|---|---|
| 2.22 | 22.7 | 31 | 129.0 | 160 |
| | | 33 | 134.7 | 168 |
| 2.25 | 22.5 | 39 | 132.4 | 171 |
| 2.29 | 36.0 | 58 | 155.8 | 214 |
| 2.33 | 35.6 | 72 | 140.5 | 212 |
| 2.36 | 37.1 | 105 | 151.5 | 256 |
| — | — | 5 | 193.4 | 198 |

TABLE 7-continued

Analysis of the coating

| pH value prior to coating | Temperature during the pH value measurement | Cr oxide coating weight (photometric) [mg/m$^2$] | Cr metal coating weight (electrochemical) [mg/m$^2$] | Actual total CR coating weight [mg/m$^2$] |
|---|---|---|---|---|
| 2.39 | 44.8 | 15 | 215.8 | 231 |
| 2.39 | 45.5 | 39 | 240.3 | 279 |
| 2.39 | 55.7 | 4 | 240.1 | 244 |
| 2.40 | 55.8 | 3 | 300.7 | 304 |
| 2.43 | 55.4 | 4 | 295.0 | 299 |

What is claimed is:

1. A method for producing a metal strip coated with a coating containing chromium metal and chromium oxide, the method comprising:

connecting the metal strip as a cathode and passing the metal strip at a predefined strip speed through a plurality of electrolysis tanks successively arranged in a strip travel direction and filled with electrolyte solution containing a trivalent chromium compound, the plurality of electrolysis tanks including at least a first electrolysis tank or a front group of electrolysis tanks and a last electrolysis tank or a rear group of electrolysis tanks;

wherein the electrolyte solution in the first electrolysis tank or in the front group of electrolysis tanks has a first temperature averaged across a volume of an electrolysis tank and the electrolyte solution in the last electrolysis tank or in the rear group of electrolysis tanks has a second temperature, averaged across a volume of an electrolysis tank, less than 40° C. and lower than the first temperature; and bringing the metal strip into contact with the electrolyte solution during an electrolysis time to electrolytically deposit the coating onto the metal strip, the coating having at least two layers with different compositions, the at least two layers including a lower layer facing the metal strip and having a first proportion by weight of chromium oxide, and an upper layer having a second proportion by weight of chromium oxide, the second proportion by weight of chromium oxide being higher than the first proportion by weight of chromium oxide;

wherein the electrolysis time, during which the metal strip is in contact with the electrolyte solution in the last electrolysis tank or in the rear group of electrolysis tanks, is less than 2.0 seconds.

2. The method as in claim 1, wherein the electrolysis time, during which the metal strip is in electrolytic contact with the electrolyte solution in each electrolysis tank of the plurality of electrolysis tanks, is less than 2.0 seconds.

3. The method as in claim 1, wherein the electrolysis time, during which the metal strip is in electrolytic contact with the electrolyte solution in each electrolysis tank of the plurality of electrolysis tanks, is between 0.3 and 2.0 seconds.

4. The method as in claim 1, wherein a total electrolysis time, during which the metal strip is in electrolytic contact with the electrolyte solution in the plurality of electrolysis tanks is between 2 and 16 seconds.

5. The method as in claim 1, wherein a mean second temperature of the electrolyte solution in the last electrolysis tank or in the rear group of electrolysis tanks is between 25° C. and 38° C.

6. The method as in claim 1, wherein a mean first temperature of the electrolyte solution in the first electrolysis tank or in the front group of electrolysis tanks is greater than 40° C.

7. The method as in claim 1, wherein a temperature of the electrolyte solution, averaged across the volume of the electrolysis tank, in each electrolysis tank of the plurality of electrolysis tanks is between 20° C. and 40° C.

8. The method as in claim 7, wherein the temperature of the electrolyte solution, averaged across the volume of the electrolysis tank, in each electrolysis tank of the plurality of electrolysis tanks is between 25° C. and 38° C.

9. The method as in claim 1, wherein a mean first temperature of the electrolyte solution in the first electrolysis tank or in the front group of electrolysis tanks is higher than a mean second temperature of the electrolyte solution in the last electrolysis tank or the rear group of electrolysis tanks.

10. The method as in claim 9, wherein the plurality of electrolysis tanks further includes a second electrolysis tank or a middle group of electrolysis tanks arranged following the first electrolysis tank or the front group of electrolysis tanks and before the last electrolysis tank or the rear group of electrolysis tanks; and wherein the first electrolysis tank or the front group of electrolysis tanks has a low current density ($j_1$), the second electrolysis tank or the middle group of electrolysis tanks has a medium current density ($j_2$), and the last electrolysis tank or the rear group of electrolysis tanks has a high current density ($j_3$), wherein the low current density ($j_1$) is greater than 20 A/dm$^2$ and the high current density ($j_3$) is higher than the low current density ($j_1$) and the medium current density ($j_2$).

11. The method as in claim 1, wherein the trivalent chromium compound comprises basic Cr(III) sulfate ($Cr_2(SO_4)_3$).

12. The method as in claim 1, wherein the electrolyte solution 12 further comprises at least one complexing agent and an alkali metal sulfate.

13. The method as in claim 12, wherein the alkali metal sulfate is potassium sulfate or sodium sulfate and the electrolyte solution is at least one of free of halides and free of a buffering agent.

14. The method as in claim 1, wherein the trivalent chromium compound in the electrolyte solution has a concentration of at least 10 g/L.

15. The method as in claim 1, wherein a pH value of the electrolyte solution, measured at a temperature of 20° C. is between 2.0 and 3.0.

16. The method as in claim 1, wherein the predefined strip speed is at least 100 m/min.

17. The method as in claim 1, wherein the coating has a total coating weight of chromium of at least 40 mg/m$^2$, wherein a proportion of chromium oxide contained in the total coating weight is at least 5%.

18. The method as in claim 1, wherein the coating has a chromium oxide content with a coating weight of chromium bound as chromium oxide of at least 5 mg of Cr per m$^2$.

19. The method as in claim 1, wherein the lower layer has a first proportion by weight of chromium oxide in a range from 10% to 15% and the upper layer has second a proportion by weight of chromium oxide of more than 30%.

20. The method as in claim 19, wherein the coating further comprises a middle layer arranged between the lower and upper layers, the middle layer having a middle proportion by weight of chromium oxide in a range from 2% to 10%.

21. The method as in claim 1, further comprising, following the electrolytic deposition of the coating, applying a top coat of organic material to the coating.

22. The method as in claim 1, wherein the metal strip is a tin-free steel strip or a steel strip coated with tin.

* * * * *